US005269675A

United States Patent [19]

Cox

[11] Patent Number: 5,269,675

[45] Date of Patent: Dec. 14, 1993

[54] TOOL FOR FORMING A BEVELED EDGE ON CEMENT WORK

[76] Inventor: Jerry W. Cox, 15530 Merriman, Romulus, Mich. 48174

[21] Appl. No.: 951,875

[22] Filed: Sep. 28, 1992

[51] Int. Cl.[5] ..... B28B 1/29; B28B 21/92

[52] U.S. Cl. ..... 425/458; 15/235.3; 15/235.7

[58] Field of Search ..... 425/458, 12, 873, 470; 15/105.5, 235.3, 235.4, 235.5, 235.6, 235.7, 235.8

[56] References Cited

U.S. PATENT DOCUMENTS

| | | | |
|---|---|---|---|
| 361,692 | 4/1887 | Gray | 15/235.3 |
| 460,644 | 10/1861 | Maurer | 15/235.3 |
| 460,645 | 10/1891 | Maurer | 15/235.7 |
| 867,819 | 10/1907 | Grundmann | 15/235.3 |
| 930,374 | 8/1909 | Harrop | 15/235.3 |
| 1,061,085 | 5/1913 | Kolson | 15/235.3 |
| 1,295,735 | 2/1919 | Grundmann | 15/235.3 |
| 1,347,938 | 7/1920 | Conelly | 15/235.3 |
| 1,416,521 | 5/1922 | Stout | 15/235.7 |
| 1,490,094 | 4/1924 | Daly | 15/235.7 |
| 2,179,563 | 11/1939 | Sassano | 15/235.8 |
| 2,270,541 | 1/1942 | Martin | 425/458 |
| 2,419,167 | 4/1947 | Sanford | 15/235.7 |
| 2,617,336 | 11/1952 | Brickler | 15/235.3 |
| 3,082,460 | 3/1963 | Haivala | 15/235.8 |
| 3,743,470 | 7/1973 | Bickham | 425/458 |
| 4,666,970 | 6/1987 | Perry | 425/458 |
| 4,737,097 | 4/1988 | Cotugno | 425/458 |
| 4,766,634 | 8/1988 | De Vitis | 425/458 |
| 4,766,635 | 8/1988 | DeVitis | 15/235.4 |
| 4,915,610 | 4/1990 | Curry | 15/235.4 |

*Primary Examiner*—Jay H. Woo
*Assistant Examiner*—Joseph Leyson
*Attorney, Agent, or Firm*—Charles W. Chandler

[57] ABSTRACT

A cement finishing tool for forming a beveled edge around the top of a cylindrical pedestal. The soft cement is disposed in an open top cylindrical form. The tool is then moved around the border of the cement body adjacent the form so that a curved lip, engaging the inside surface of the form, removes a strip of cement having a triangular shaped cross-section.

In another form of the invention, the tool has an elongated straight lip for forming a straight beveled edge in a cement body.

2 Claims, 2 Drawing Sheets

TOOL FOR FORMING A BEVELED EDGE ON CEMENT WORK

BACKGROUND OF THE INVENTION

Cylindrical cement pedestals, commonly used for supporting light poles and the like, have a flat top with a beveled, circular edge. Commercial practice is to use the cylindrical form into which the cement is to be poured. A typical form may have a diameter of about 24 inches. A rubber strip, having a triangular cross-section, is nailed to the inside of the form at the pedestal height. The cement is then poured into the form to the height of the rubber strip. When the cement has hardened, the form, together with the rubber strip, is peeled from the pedestal. The rubber strip is expensive. Installing the strip is also expensive because of the installation time required.

Some cement finishing tools are known in the prior art for forming a beveled edge in cement work. For example, U.S. Pat. No. 4,766,634 which was issued Aug. 30, 1988 to Louis DeVitis; U.S. Pat. No. 4,737,097 which was issued Apr. 12, 1988 to Joseph A. Cotugno; U.S. Pat. No. 4,669,970 which was issued Jun. 2, 1987 to John F. Perry; U.S. Pat. No. 2,419,167 which was issued Apr. 15, 1947 to Cyrus Sanford; U.S. Pat. No. 1,347,938 which was issued Jul. 27, 1920 to H. F. Conelly and U.S. Pat. No. 460,645 which was issued Oct. 6, 1891 to Martin Maurer.

The DeVitis patent shows a hand tool with a circular plate-like body with a downward turned lip intended to be used for shaping the exterior corner of a cement surface. Generally, such devices employ a thin plate-like body having a downturned lip. The Conelly tool appears to be made from a relatively thick body or perhaps of a casting.

SUMMARY OF THE INVENTION

The broad purpose of the present invention is to provide an improved method for making a cylindrical cement pedestal with a beveled edge which eliminates the time-consuming conventional process of either mounting a rubber strip either around the inside or around the top edge of the form.

The preferred embodiment of the invention employs a cast metal tool having a relatively flat body with a handle for manipulating the tool. One edge of the body has a curved, downwardly-depending lip. The lip has a generally triangular cross-section. The outside surface of the lip is curved to correspond to the inner curvature of the cement form. The inside or back surface of the lip is flat. The arrangement is such that the thickest part of the lip is at its midsection. Consequently, the lip is somewhat tapered from such end toward the midsection. The nose or leading edge of the lip is also tapered in a second direction. The tool, as it is being guided around the cement, the cylindrical form, remove a triangular section of cement to form a groove. The groove is gradually enlarged as the tool is advanced in a 360° path.

In another form of the invention, the tool lip has a flat, outside edge for engaging a straight wooden form. In this form of the invention, the nose of the tool is tapered to form a groove between the cement and the forms. A beveled edge remains when the form is tripped.

The tool and method results in substantial savings in time and material expense.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which.

DESCRIPTION OF THE PREFERRED EMBODIMENT OF THE INVENTION

Figure 1:
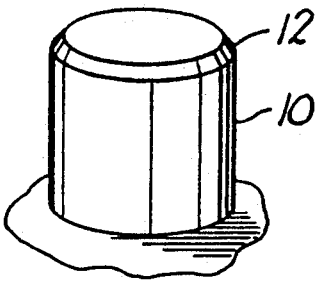
FIG. 1 shows a cement pedestal having a cylindrical sidewall and a beveled upper edge illustrating the preferred embodiment of the invention.
Figure 2:
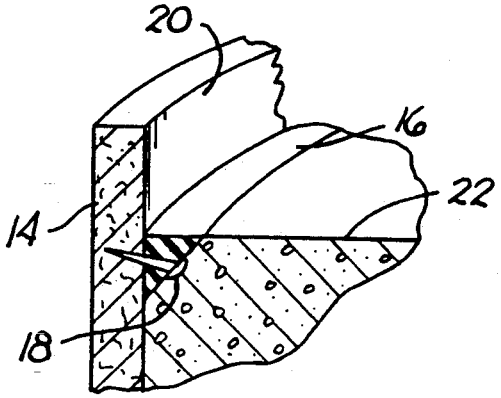
PRIOR ART FIG. 2
FIG. 2 illustrates of the conventional method for making such a beveled edge.
Figure 3:
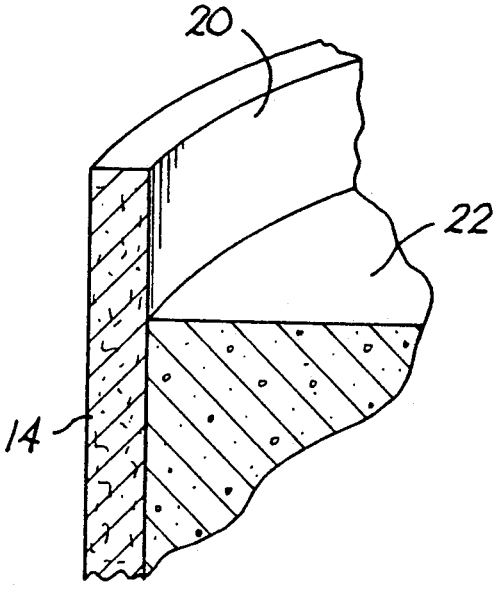
FIG. 3 is a view illustrates the first step in making a pedestal in accordance with the invention, that is, filling a cylindrical form with cement to a predetermined height.
Figure 4:
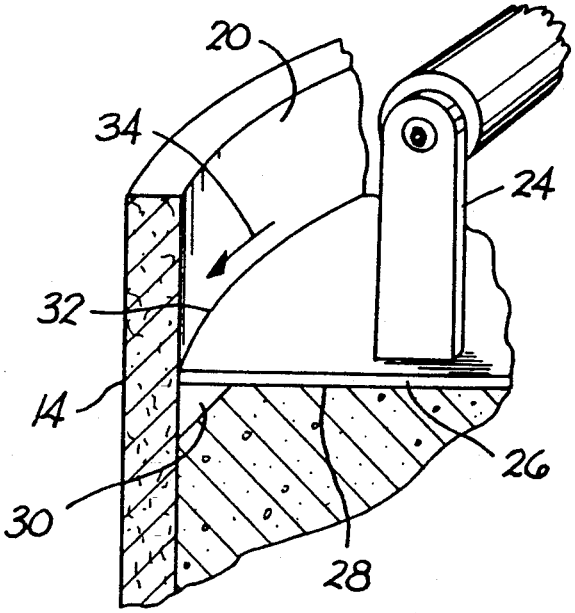
FIG. 4 is a view showing the preferred method in which a tool is passed around in contact with both the cement and the inner surface of the form to form a groove between the cement and the form.
Figure 5:
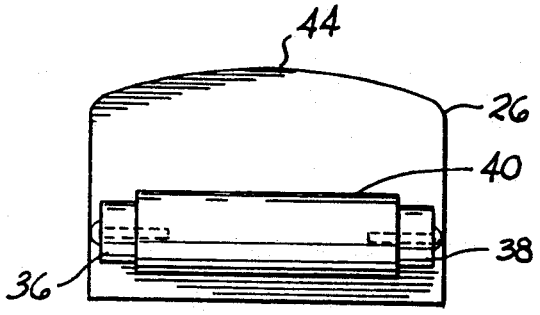
FIG. 5 is a plan view of the preferred tool.
Figure 6:
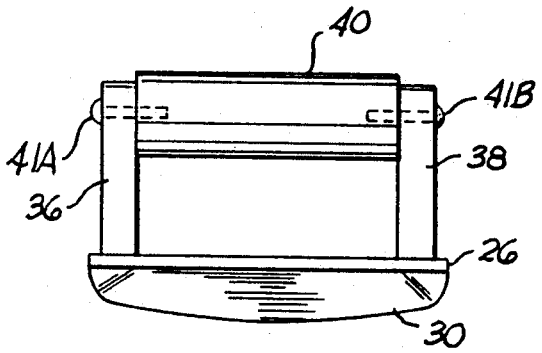
FIG. 6 is a view showing the rear end of the tool.

FIG. 1, illustrates a cement pedestal 10 having a cylindrical sidewall with a top circular beveled edge 12 made in accordance with the invention. Usually such pedestals are constructed to support an upright light post or the like. Cavities might be formed in the post for wiring. This invention is concerned with making beveled edge 12.

The conventional procedure is to employ a cylindrical form 14 of a fiber-like material. The form has a vertical height that is greater than the height of the pedestal, and an internal diameter that corresponds to the outside diameter of the finished pedestal. A rubber-like strip 16 is cut to a length accommodating the interior circumference of the form. Nails 18 attach the strip to the inner surface 20 of the form. Strip 16 is relatively expensive. In addition, it is relatively time-consuming to nail the strip at a uniform, horizontal height inside the form.

Soft cement 22 is introduced into the form to a height corresponding to the top of strip 16. When the cement has hardened, strip 16 and form 20 are striped from the hardened cement.

The preferred method of the present invention comprises employing the same form 14, but eliminates strip 16. Liquid cement 22 is introduced into the form to the height of the pedestal. While the cement is still soft, the user employs tool 24 inside the form. Tool 24 has an aluminum plate-like body 26. The bottom flat surface of the body contacts the horizontal top of the cement. The tool has a downward-depending lip 30 which is elongated and curved along its outer face at 32 to accommodate the curvature of the inside peripheral surface 20 of the form. The tool is chosen according to the diameter of the form i.e. a 24 inch form, a 26 inch form, or the like. He then moves the tool in the direction of arrow 34, around the inside of the form, guided by contact with the inside surface 20 of the form and the top of the cement. When he has moved the tool in a 360° path to form a groove between the form and the cement, then he has removed cement sufficient to form the finished beveled surface.

Tool 24 is illustrated in FIGS. 5–9. A pair of up-right posts 36 and 38, are mounted on body 26. An elongated, cylindrical handle 40, preferably of wood, has its opposite ends attached by fasteners 41A and 41B to posts 36 and 38, respectively. The handle is spaced a sufficient distance above the top of body 26 to permit the user to grasp the handle to manipulate the tool.

The tool 24 includes a tool body having a generally flat bottom surface 28 for engaging the generally flat top surface of a body of cement contained in a cylindrical cement-containing form, the tool body having an elongated generally downwardly-turned lip 30 extending from a first end 50 to a second end 52, the lip 30 having an arcuate outer surface 44 for engaging an inner cylindrical surface of the cement-containing form, the arcuate outer surface 44 extending to a bottom edge 48 which engages the body of soft cement, the lip 30 having an inner surface 46 extending from the bottom edge 48 to the bottom surface 28 of the tool body, whereby the lip increases in thickness from the bottom edge 48 to the bottom surface 28 between the arcuate outer surface 44 and the inner surface 46, the first end 50 of the lip including a linear edge bounding the arcuate outer surface and intersecting the bottom edge 48, and a generally flat inside surface, lying in plane 54, extending from a line parallel to the linear edge to the bottom surface 28 and the inner surface 46, such that the thickness of the lip increases from the linear edge toward the second end 52 between the flat inside surface and the arcuate outer surface 44.

Figure 8:
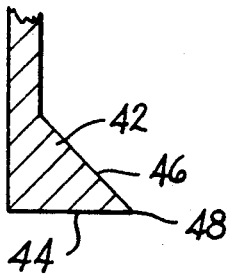
FIG. 8 is an enlarged view as seen along lines 8—8 of FIG. 7.
Figure 7:
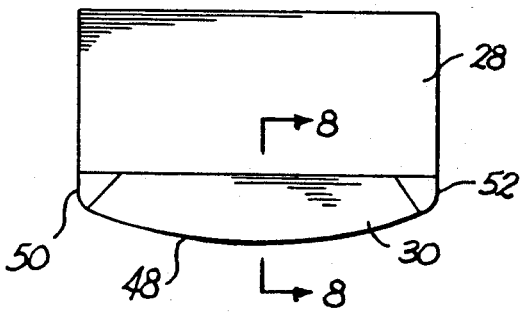
FIG. 7 is a view showing the bottom of the preferred tool.

Lip 30 has a triangular cross-section transverse to its length. At its widest point 42, the cross-section of the lip as best seen in FIG. 8, corresponds to the triangular cross-section of the material that is to be removed to form the beveled edge. The lip has an outside, curved surface 44 which has a curvature corresponding to the inner circumference of the inner surface 20 of the form. The back surface 46 of the lip lies in a flat plane that intersects surface 44 along a curved line of intersection 48. The result is that the lip is somewhat tapered from both end 50 and from opposite end 52. The lip is narrowest at its end and widest at its midsection.

Figure 9:
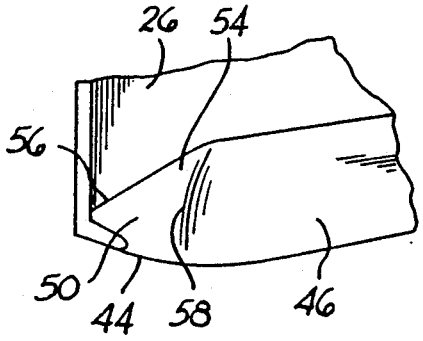
FIG. 9 is a view of the nose of the tool.

The two ends or noses 50 and 52, are preferably identical except for a right and left hand relationship. Referring to FIG. 9, nose 50 is also tapered by a surface lying in plane 54 that is inclined with respect to the plane of bottom surface 28 and inclined such that the thickness between the plane 54 and the surface 44 increases from nose 50 toward the other end.

Plane 54 intersects the bottom surface 28 of the body at an angle of about 90°. The surface 58 between plane 54 and back surface 46 is somewhat rounded. The end result is that each nose is tapered in two directions. Consequently, when the tool is inserted in the cement, the nose plows into the cement, and then gradually enlarges the amount of cement being removed as the tool is moved around the top of the pedestal. Thus, the lip essentially plows or cleaves its way through the soft cement, guided by the inner surface of the cylindrical form and the top of the cement pedestal.

Figure 10:
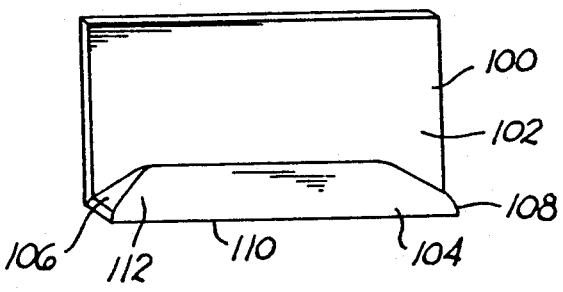
FIG. 10 is a view of another embodiment of the tool for use with a linear form.

FIG. 10 illustrates another embodiment of the invention which comprises a tool 100 having handle means, not shown, but identical to that of posts 36, 38 and handle 40. The bottom surface 102 of the tool is flat to engage the top of soft cement. It also has an elongated lip 104. The opposite ends 106 and 108 of the lip are also beveled. Outer surface 110 has a flat surface for engaging a flat linear cement form. The back side 112 of the lip is also flat to form a lip with a triangular cross-section. Ends 106 and 108 are each also beveled to form a somewhat sharpened nose to plow or cleave through the cement to form a beveled edge, the lip being guided on one side by the form, and the bottom side of the tool by the soft cement.

Thus, it is to be understood that I have described an improved method and tool for forming a cement body having a beveled edge. One form of the tool can be employed for forming a straight beveled edge as it is guided by a cylindrical form. The other form of the tool can be employed for forming a straight beveled edge.

Having described my invention, I claim:

1. A cement finishing tool for forming a beveled edge in the circular border of a body of soft cement contained in a cylindrical cement-containing form, comprising:

a tool body having a generally flat bottom surface for engaging a generally flat top surface of a body of soft cement contained in a cylindrical cement-containing form, said body of soft cement having a circular border with a relatively sharp circular edge, the tool body having an elongated generally downwardly-turned lip extending from a first end to a second end and having a depth below said bottom surface corresponding to a depth of the beveled edge to be formed in the body of soft cement, the lip having an arcuate outer surface for engaging an inner cylindrical surface of the cement-containing form, the arcuate outer surface extending to a bottom edge which engages the body of soft cement, the lip having an inner surface extending from said bottom edge to the bottom surface of the body, whereby the lip increases in thickness from the bottom edge to the flat bottom surface of the body between the arcuate outer surface and the inner surface, the first end of the lip including a linear edge bounding the arcuate outer surface and intersecting the bottom edge, and a generally flat inside surface extending from a line parallel to the linear edge to the bottom surface (28) and the inner surface (46), such that the thickness of the lip increases from the linear edge toward the second end between the flat inside surface and the arcuate outer surface to form a generally wedge-shaped structure for plowing through the wet cement to form a beveled edge in the cement body as the arcuate outer surface slideably engages the cement-containing form.

2. A cement-finishing tool as defined in claim 1, in which the linear edge of the first end is disposed at right angles to a plane containing the flat bottom surface of the body.

* * * * *